US005346124A

United States Patent [19]

Chess

[11] Patent Number: 5,346,124

[45] Date of Patent: Sep. 13, 1994

[54] CERTIFIED MAILER

[75] Inventor: Stanley C. Chess, Jerome, Id.

[73] Assignee: Moore Business Forms, Inc., Grand Island, N.Y.

[21] Appl. No.: 84,593

[22] Filed: Jul. 1, 1993

[51] Int. Cl.[5] ..... B65D 27/06

[52] U.S. Cl. ..... 229/305; 229/306

[58] Field of Search ..... 229/300, 301, 305, 306

[56] References Cited

U.S. PATENT DOCUMENTS 2,156,142 4/1939 Blitz .
3,062,431 11/1962 Rabenold .
3,411,699 11/1968 Pine et al. .
4,190,162 2/1980 Buescher .
4,334,618 6/1982 Buescher .
4,403,696 9/1983 Newell .
4,815,654 3/1989 Buescher .
5,011,069 4/1991 Bowen et al. .
5,169,061 12/1992 Buescher .
5,183,203 2/1993 Sanders .
5,248,082 9/1993 Elmlinger ..... 229/306 X
5,253,803 10/1993 Chess ..... 229/306 X
5,267,898 12/1993 Doll et al. ..... 229/300 X
5,277,362 1/1994 Wilson ..... 229/305

*Primary Examiner*—Allan N. Shoap
*Assistant Examiner*—Jes F. Pascua
*Attorney, Agent, or Firm*—Nixon & Vanderhye

[57] ABSTRACT

A return mailer has both the outgoing address and the reply address printed on the top face of the top ply, which with a bottom ply forms both the outgoing and reply envelopes. The reply address is covered by a return receipt having a certified or insured or registered mail number on the top face, and receipt addressee information (substantially the same as the reply address) on the bottom face, or the reply address may be covered by a simple sheet of paper. A perforation intersects the outgoing address area of the top ply, and the bottom ply has a fold line aligned with the perforation to define a return envelope flap, having a sealing agent on the top face. A readily removable insert ply is preferably disposed between the top and bottom plies, and the bottom ply bottom face is devoid of address indicia.

25 Claims, 4 Drawing Sheets

CERTIFIED MAILER

BACKGROUND AND SUMMARY OF THE INVENTION

Mailers are a very common type of business form. Numerous conventional mailers exist, however some of such conventional mailers have been rendered obsolete by restriction imposed by the United States Postal Service concerning the placement of the address information on mailers. Also, many manufacturers of computer printers are placing restrictions on the thickness of forms that can be handled by the printers. Many new printers are unable to handle the traditional self-mailer product, but require reduced thickness mailers.

One approach to providing a return mailer business form which overcomes the drawbacks set forth above is illustrated and described in copending application Ser. No. 07/903,280 filed Jun. 24, 1992 (Atty Ref: 263–722, 91–26 (091)), in which the outgoing address visible on the top ply of the mailer is ultimately covered up by folding over the flap of the second ply of the mailer, and which has the reply address information printed on the bottom face of the second ply (having the return envelope flap). While such a return mailer is advantageous in a number of situations, it requires a third ply to cover the reply address, adhesively connected thereto, otherwise it may not comply with postal regulations, and has an unusual opening procedure.

According to the present invention a return mailer is provided which has the same advantages as the mailer described in said copending application, but additionally can provide a conventional insert and has a normal opening procedure. Also, the return mailer according to the present invention is preferably associated with a return receipt. A return receipt is a receipt for registered, certified, or insured mail with an identifying number thereon, and with receipt addressee indicia, facilitating mailing back to the organization sending out the certified, registered, or insured piece of mail. The return receipt covers the reply address on the top face of the top ply of the mailer, and when the return receipt is removed, the reply address for the return envelope is readily visible. Also, when opening up the mailer, the outgoing address is mutilated and/or covered up by folding over of the return envelope flap so that only the reply address is visible on the return envelope.

According to one aspect of the present invention, a return mailer is provided which comprises the following elements: A top ply having an outgoing address area for receiving outgoing address indicia visible when viewing a top face thereof, and extending in a first direction, the top ply also having a bottom face. A first line of weakness formed in the top ply extending substantially transverse to the first direction and intersecting or adjacent the outgoing address indicia visible when viewing the top face of the top ply, the first line of weakness defining the top ply into a body portion and a stub portion. A second ply connected to and cooperating with the top ply to forming an outgoing and reply envelope, the second ply having a top face facing the top ply bottom face, and a bottom face, the bottom face being devoid of address indicia. A first fold line formed in the second ply in substantial alignment with the first line of weakness and defining the second ply into a body portion, and a flap portion. A sealing agent disposed on the second ply top face on an endmost area of the flap portion. The flap portion having a length sufficient, when the second ply is folded about the first fold line, to completely cover any outgoing address indicia visible when viewing the top face of the top ply within the outgoing address area. Reply address indicia visible when viewing the top face of the top ply body portion, remote from the outgoing address area. And means for removably covering the reply address indicia.

Typically, the second ply is of substantially the same size as the first ply, and is connected to it by adhesive patterns acting between the bottom face of the top ply and the top face of the second ply. An insert ply may be disposed between the top and second plies, and means for readily detachably mounting an insert ply between the top and second plies may comprise a perforation line. A fly sheet may overlie and be detachable from the top ply. The fly sheet, if used, has a bottom face with image transferring material (such as a carbon spot) on it, overlying the outgoing address area on the top ply. The sealing agent may be a strip of rewettable adhesive, or a piece of transfer tape covered by a release strip, in either case extending parallel to the first line of weakness.

In the preferred embodiment the means for removably covering the reply address indicia comprises a return receipt, although it may also comprise a receipt sheet cooperating with a reply sheet. The return receipt has a top face visible when viewing the top face of the top ply, and the top face has a certified, insured, or registered mail number thereon. The bottom face of the return receipt has receipt addressee indicia thereon, typically the same as the reply address indicia (that is, containing substantially the same address information, although not necessarily having the same print type, orientation, arrangement of elements, etc.). The return receipt is typically removably attached to the top ply by first and second parallel, spaced, strips of adhesive remote from the outgoing address, and substantially transverse to the first direction. Second and third lines of weakness are formed in the return receipt adjacent the first and second strips of adhesive, the certified or registered or insured mail number being provided between the second and third lines of adhesive.

According to another aspect of the present invention a return mailer is provided comprising the following elements: A top ply having an outgoing address area for receiving outgoing address indicia visible when viewing a top face thereof, the top ply also having a bottom face. A second ply connected to and cooperating with the top ply to forming an outgoing and reply envelope, the second ply having a top face facing the top ply bottom face, and a bottom face, the bottom face being devoid of address indicia. A first fold line formed in the second ply defining the second ply into a body portion, and a flap portion. A sealing agent disposed on the second ply top face on an endmost area of the flap portion. Reply address indicia visible when viewing the top face of the top ply body portion, remote from the outgoing address area. And a return receipt for removably covering the reply address indicia, and having a top face visible when viewing the top face of the top ply, the top face having a certified or insured or registered mail number thereon, and a bottom face, the bottom face having receipt addressee indicia thereon.

According to still another aspect of the present invention, another embodiment of return mailer is provided comprising the following elements: A top ply having an outgoing address area with outgoing address indicia printed thereon, the top ply also having a bottom face.

A second ply connected to and cooperating with the top ply to forming an outgoing and reply envelope, the second ply having a top face facing the top ply bottom face, and a bottom face, the bottom face being devoid of address indicia. Reply address indicia printed on the top face of the top ply body portion, remote from the outgoing address area, the reply address indicia and the outgoing address indicia extending in the same, first, direction. And a return receipt for removably covering the reply address indicia, and having a top face visible when viewing the top face of the top ply, the top face having a certified or insured or registered mail number thereon, and a bottom face, the bottom face having receipt addressee indicia thereon.

It is a primary object of the present invention to provide a simple, relatively thin, mailer which meets all U.S. Postal requirements regarding proper addressing and mailing, and particularly one that is useful with a return receipt. This and other objects of the invention will become clear form an inspection of the detailed description of the invention and from the appended claims.

DETAILED DESCRIPTION OF THE DRAWINGS

Figure 1:
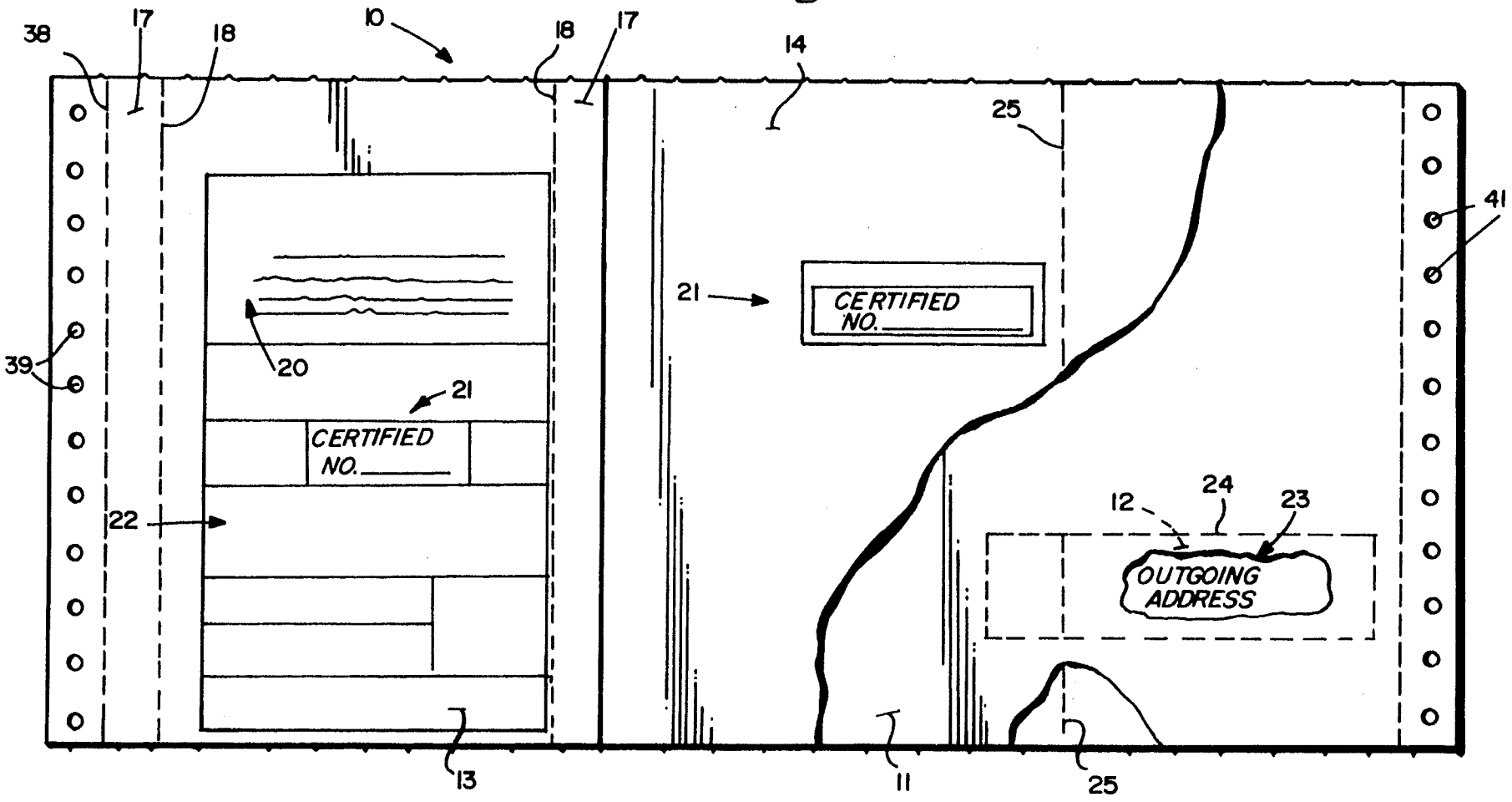
FIG. 1 is a top plan view, with the majority of a cover ply (fly sheet) cut away for clarity of illustration, of an exemplary return mailer according to the present invention.
Figure 2:
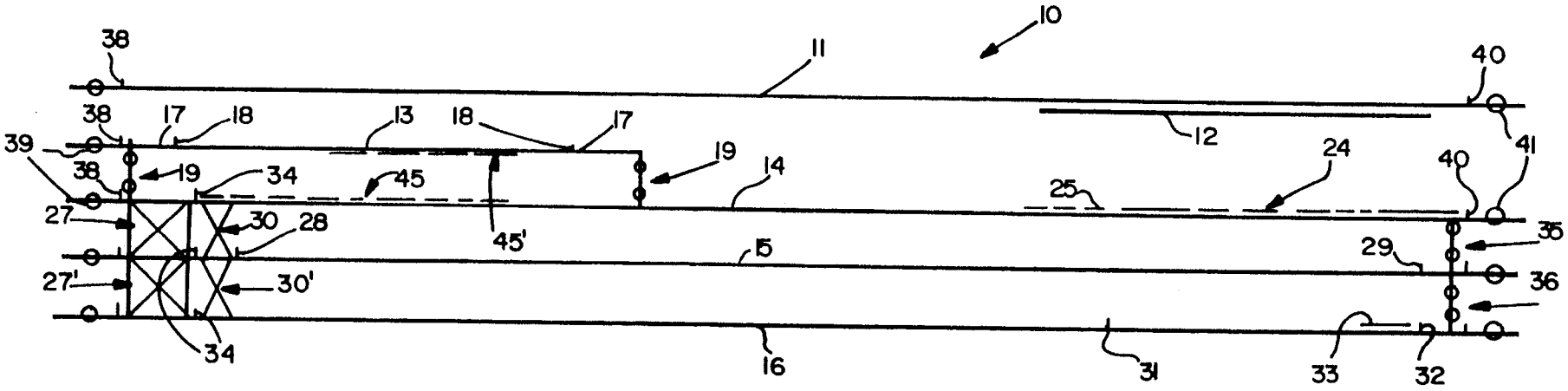
FIG. 2 is a cross sectional schematic illustrating the mailer of FIG. 1.
Figure 3:
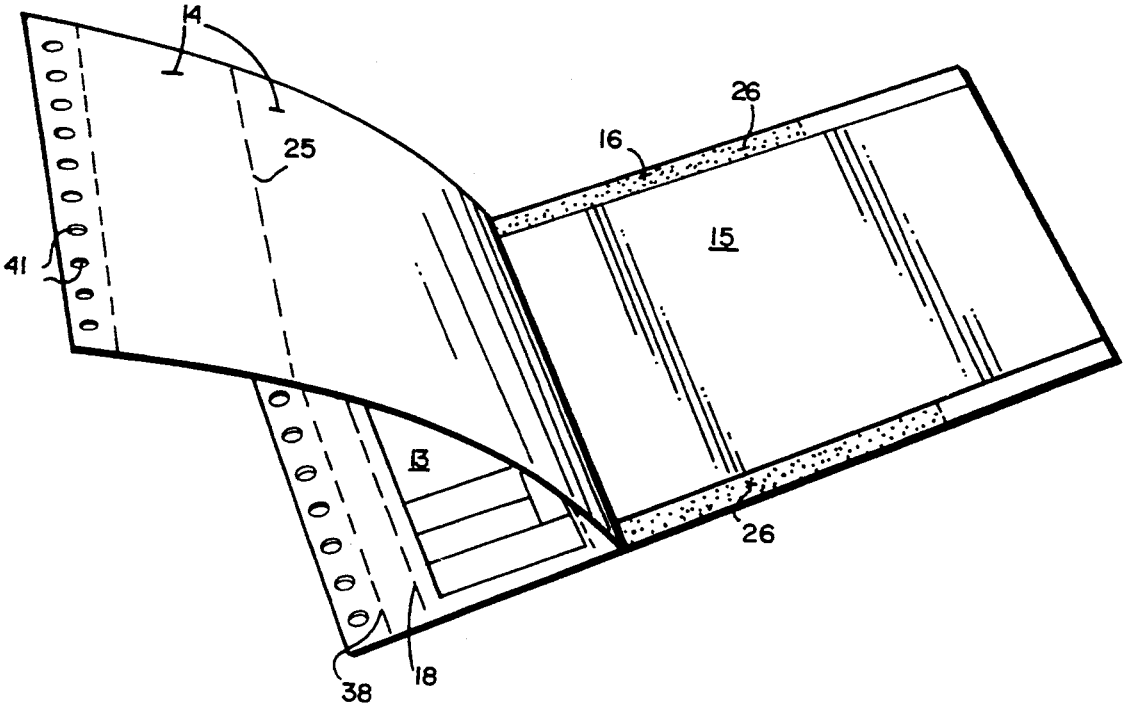
FIGS. 3 and 4 are top perspective views with, respectively, the top ply and insert ply folded back for clarity of illustration.

An exemplary mailer according to the present invention is shown generally by reference numeral 10 in FIGS. 1 and 2. In FIGS. 1 and 2 the return mailer 10 is shown with a cover ply or fly sheet 11 having image transferring material 12 disposed on the bottom face thereof. In the actual outgoing form, however, the fly sheet 11 will be removed to serve as a record copy. The image transferring material 12 may comprise a carbon spot, or the like, so that if the top face of the cover ply 11 is impacted, as with a typewriter element, indicia formed thereon will be transferred to the underlying ply.

The return mailer 10 also comprises a return receipt 13, which also functions as a means to cover a reply address printed on the underlying,"top", ply 14 of the mailer 10 as will be hereinafter described. The mailer 10 also comprise an insert ply 15 and a second, or bottom, ply 16.

The return receipt 13 is connected to the top ply 14 in a conventional manner by strips of adhesive or spot pasted adhesive 19 (see FIG. 2) which are parallel to each other and to the side edges of the return mailer 10, the adhesive strips 19 being covered by the sections 17 of the return receipt 13, the main body of which is connected to the sections 17 by the lines of weakness (perforations) 18. The top face (visible in FIGS. 1 and 3 through 5) of the return receipt 13 has various indicia 20, 22 printed thereon, including the indicia 21. The indicia 21 comprises a certified or insured or a registered mail number, and preferably like indicia 21 (see FIGS. 1 and 5) provided on the top ply 14 (that is the same certified, registered, or insured mail number).

On the top face of the top ply 14 an outgoing address area 24 is provided, underlying the carbon spot 12, and which is adapted to have the outgoing addressee indicia 23 (see FIG. 1) printed thereon. A first line of weakness (perforation) 25 is provided in the top ply 14 substantially transverse to the direction in which the outgoing address indicia 23 (see FIG. 1) extends. That is, the perforation 25 is parallel to the side edges of the mailer 10, and perpendicular to the side edges of thereof. The perforation 25 defines the top ply 14 into a body portion (to the left of the line 25 in FIG. 1) and a stub portion (to the right of the line 25 in FIGS. 1 and 2).

The top ply 14 is connected to underlying plies by adhesive strips, as is conventional, to form the outgoing mailer and return envelope. For example, the strips 26 of adhesive are provided along the end edges of the second ply 16 top face and/or the end edges of the bottom face of the top ply 14, to hold the substantially same size plies 14, 16 together along the end edges thereof. The adhesive strips or spot pasted adhesive 27, 27' (shown schematically in FIG. 2) hold the plies 14, 16, respectively to the insert ply 15. A perforation line 28 formed in the insert ply 15 parallel to the perforation line 25, and provides a means for readily detachably connecting the insert ply 15 to the other plies 14, 16. Note that the insert ply 15 has a lesser width than the plies 14, 16 (see FIGS. 3 and 4) so that it is not engaged by the adhesive strips 26. Also, the side portions of the plies 14 through 16 of the mailer 13 having the tractor drive openings 39, 41 therein are connected together by adhesive as indicated by the adhesive connections 35, 36 in FIG. 2. Perforation lines 29, 32 are provided in the plies 15, 16 to allow the right side strip to be detached to open up the mailer 10 (as viewed in FIG. 2), while the perforations 38 are provided in the sheet/plies 11, and 13 through 16 at the left side (as seen in FIG. 2) thereof.

As also seen in FIG. 2, perforations 34 also may be provided in the plies 14–16, and glue lines or spot pasting 30, 30' are provided on the opposite sides of perforations 34 from glue lines or spot pasting 27, 27'. Where ply 13 is a substantially plain paper cover sheet (rather than a "certified" ply) with a carbon spot on the back (not shown in FIG. 2), hiding and manifolding the reply address 45, the adhesive 19, when used, would not require rightmost perf 18. Rather, ply 13 could be broken off at leftmost perf 18, and the form separated at perfs 34 too, and then peeled off.

Figure 4:
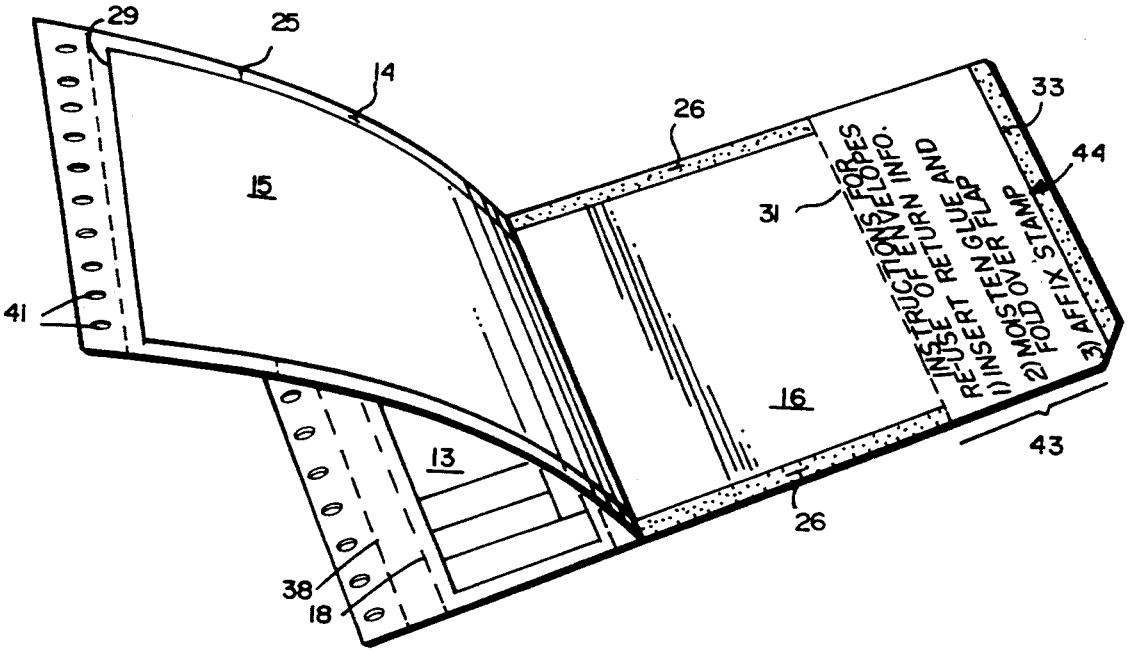
Figure 5:
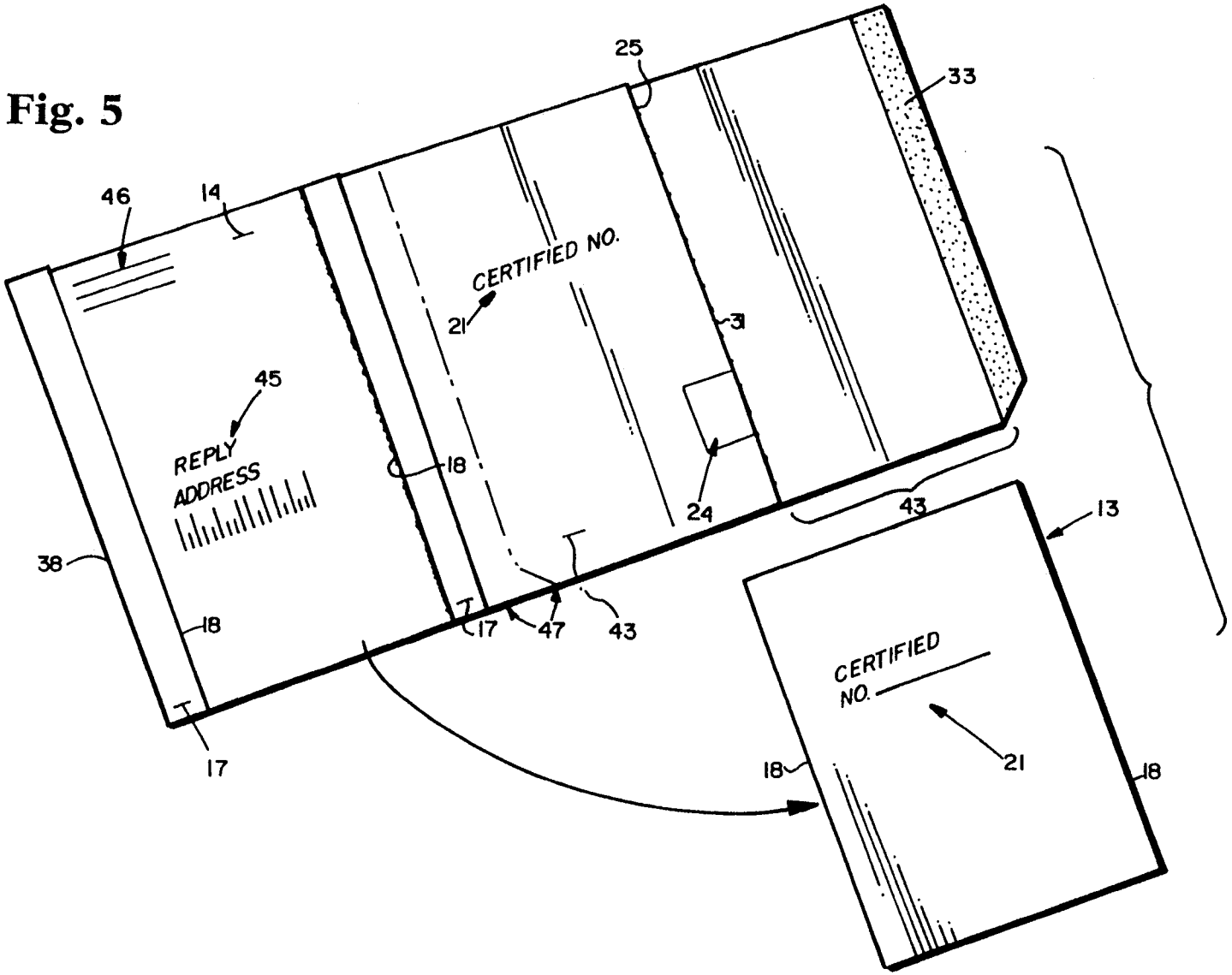
FIG. 5 is a top perspective view showing the mailer of FIG. 1 once the return receipt has been detached therefrom, and with the return envelope ready to have any inserts provided thereon, and then have the return envelope flap folded over.

As seen in FIGS. 2, 4, and 5, the second or bottom ply 16 has a fold line 31 (which may also comprise a line of weakness, such as a perforation line) in substantial alignment with the line of weakness 25 in the top ply 14, and defining to the right thereof (as viewed in FIGS. 2, 4, and 5) a flap 43 of a return envelope. A sealing agent, such as the strip of rewettable adhesive 33, or strip of transfer tape covered by a release liner, is provided at the right side of the flap 43 to seal the return envelope formed by opening up the mailer 10. Indicia 44 (see FIG. 4) may be printed on the flap 43 providing instructions on how to use the return envelope, etc.

The mailer 13 also comprises reply address indicia 45 (see FIGS. 2 and 5) preferably printed on the top face of the top ply 14, underlying the main body portion of the return receipt 13, and covered by the return receipt 13 until receipt 13 is detached from the rest of the mailer 10 at the perforation lines 18 (FIG. 5 illustrates the return receipt 13 so detached). The indicia 45 also can be printed via carbon spot on an overlying sheet (e.g. on the back of ply 13 if merely a cover sheet). The reply address indicia 45, which preferably includes human readable indicia, as well as bar code, is preferably substantially identical to receipt addressee indicia 45' (see FIG. 2) printed on the bottom face of the return receipt 13 (that is the face thereof opposite the certified, registered, or insured indicia 21). Also, on the top face of the top ply 14 underlying the return receipt 13 there may be lines 46 for return address indicia associated with the reply envelope, the reply envelope being shown generally by reference numeral 47 in FIG. 5.

According to the invention, there is no necessity for placing any reply address indicia, or any other address indicia, on the bottom face of the second ply 16. Therefore, the bottom face of the second ply 16 is devoid of address indicia.

The mailer 10 according to the present invention is utilized in the following manner:

With the fly or cover sheet/ply 11 in place, and the mailers 10 in continuous form (connected together at the end edges thereof) they are fed by the tractor feed holes 39, 41 through a printer, which impacts outgoing address information on the portion of each fly sheet 11 having a carbon spot 12 thereon, which information is then transferred to the outgoing address area 24 on the top face of the top ply 14, providing the outgoing address 23 thereon. The reply address can also be printed at this same time, being transferred to ply 14 via spot 12. Then the fly sheet 11 is removed and saved as a record copy. The mailer 10, without the fly sheet 11, is then mailed (certified, registered, or insured) with the outgoing address indicia 23 readily visible, and the reply address indicia 45 covered by the return receipt 13.

When the postman delivers the mailer 10, he/she has the outgoing addressee sign (at area 22) the top face of the return receipt 13. The return receipt 13 is then detached from the rest of the mailer at the perforation lines 18 (see FIG. 5), and it is mailed back, addressed to the receipt addressee as indicated by indicia 45'. After the ply 11 is detached, the portions of the mailer 10 having the tractor feed openings 39, 41 may also be detached at the perforations 38, 40, respectively, and/or detachment at perfs 34 also can be provided.

The outgoing addressee then opens up the mailer 10, by detaching at the perforations 25, 29, 32. This allows access to the insert ply 15, while at the same time removing all (or the majority of) the outgoing address indicia 23 in the outgoing addressee area 24. The insert ply 15 is then removed by grasping the right edge thereof and pulling outwardly, detaching it at the perforation 28. The insert ply 15 can have any suitable information thereon, and may include a return stub or return stub indicia. Alternatively, return stub indicia may be provided on the bottom face of the portion of the top ply 14 to the right of the perforation line 25 as viewed in FIGS. 1 and 2.

Once the outgoing addressee is ready to send back the return envelope 47 to the reply address 45 (which is now readily visible on the top face of the top ply 14), he/she inserts whatever information is necessary into the reply envelope 47, and then folds the flap 43 about the fold line 31. The rewettable adhesive 33 is activated so as to seal the flap 43 in place, the adhesive 33 engaging the top face of the top ply 14. The flap 43 of the return envelope 47 has a sufficient width so that it covers any outgoing address indicia 23 still visible in the area 24, and at the same time covers the certified number (or other like indicia) 21 that is printed on the top face of the top ply 14. However, when the reply addressee receives the reply envelope 47, the reply addressee may open the envelope by tearing along the fold/perforation line 31, and the certified number indicia 21 can be viewed by bending back the flap 43.

While the invention has been specifically described with respect to use of a return receipt 13, other mechanisms may be used for covering the reply address indicia 45, including, but not limited to, a file copy sheet similar to the fly sheet 13, a masking sheet adhesively attached in place, a promotional item, or the like.

While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent products and devices.

What is claimed is:

1. A return mailer comprising:

a top ply having an outgoing address area for receiving outgoing address indicia visible when viewing a top face thereof, and extending in a first direction, said top ply also having a bottom face;

a first line of weakness formed in said top ply extending substantially transverse to said first direction in the area of said outgoing address indicia visible when viewing said top face of said top ply, said first line of weakness defining said top ply into a body portion and a stub portion;

a second ply connected to and cooperating with said top ply to forming an outgoing and reply envelope, said second ply having a top face facing said top ply bottom face, and a bottom face, said bottom face being devoid of address indicia;

a first fold line formed in said second ply in substantial alignment with said first line of weakness and defining said second ply into a body portion, and a flap portion;

a sealing agent disposed on said second ply top face on an endmost area of said flap portion;

said flap portion having a length sufficient, when said second ply is folded about said first fold line, to completely cover any outgoing address indicia visible when viewing said top face of said top ply within said outgoing address area;

reply address indicia visible on said top face of said top ply body portion, remote from said outgoing address area; and means for removably covering said reply address indicia.

2. A mailer as recited in claim 1 wherein said second ply is of substantially the same size as said first ply, and is connected thereto by adhesive patterns acting between said bottom face of said top ply, and said top face of said second ply.

3. A mailer as recited in claim 1 wherein said means for removably covering said reply address indicia comprises a return receipt.

4. A mailer as recited in claim 3 wherein said return receipt has a top face visible when viewing the top face of said top ply, said top face having a certified or insured or registered mail number thereon, and a bottom face, said bottom face having receipt addressee indicia thereon.

5. A mailer as recited in claim 4 wherein said receipt addressee indicia comprises address information substantially identical to said reply address indicia.

6. A mailer as recited in claim 3 further comprising a certified or insured or registered mail number printed on said top face of said top ply between said return receipt and said first line of weakness; and wherein said flap portion of said second ply has sufficient length, when folded about said first fold line, to cover said mail number printed on said top face of said top ply.

7. A mailer as recited in claim 4 wherein said return receipt is removably attached to said top ply by first and second parallel, spaced, strips of adhesive or spot pasted adhesive, remote from said outgoing address, and substantially transverse to said first direction; and further comprising second and third lines of weakness formed in said return receipt adjacent said first and second strips of adhesive, said certified or insured or registered mail number being provided between said second and third lines of weakness.

8. A mailer as recited in claim 7 further comprising an insert ply disposed between said top and second plies, and means for readily detachably mounting said insert ply between said top and second plies.

9. A mailer as recited in claim 7 further comprising a fly sheet overlying and detachable from said top ply, said fly sheet having a bottom face with image transferring material thereon, overlying said outgoing address area of said top ply.

10. A mailer as recited in claim 7 wherein said first fold line is a line of weakness.

11. A mailer as recited in claim 1 wherein said sealing agent is selected from the group consisting of a strip of rewettable adhesive, and a piece of transfer tape covered by a release material, said strip or said tape extending parallel to said first line of weakness.

12. A mailer as recited in claim 1 further comprising an insert ply disposed between said top and second plies, and means for readily detachably mounting said insert ply between said top and second plies.

13. A mailer as recited in claim 1 further comprising a fly sheet overlying and detachable from said top ply, said fly sheet having a bottom face with image transferring material thereon, overlying said outgoing address area of said top ply.

14. A mailer as recited in claim 1 wherein said reply address indicia is printed on said top face of said top ply, and wherein outgoing address indicia is printed on said top face of said top ply within said outgoing address area, and wherein said reply address indicia also extends in said first direction.

15. A return mailer comprising:

a top ply having an outgoing address area for receiving outgoing address indicia visible when viewing a top face thereof, said top ply also having a bottom face;

a second ply connected to and cooperating with said top ply to forming an outgoing and reply envelope, said second ply having a top face facing said top ply bottom face, and a bottom face, said bottom face being devoid of address indicia;

a first fold line formed in said second ply defining said second ply into a body portion, and a flap portion;

a sealing agent disposed on said second ply top face on an endmost area of said flap portion;

reply address indicia visible when viewing said top face of said top ply body portion, remote from said outgoing address area; and a return receipt for removably covering said reply address indicia, and having a top face visible when viewing the top face of said top ply, said top face having a certified or insured or registered mail number thereon, and a bottom face, said bottom face having receipt addressee indicia thereon.

16. A mailer as recited in claim 15 wherein said second ply is of substantially the same size as said first ply, and is connected thereto by adhesive patterns acting between said bottom face of said top ply, and said top face of said second ply.

17. A mailer as recited in claim 15 wherein said receipt addressee indicia comprises address information substantially identical to said reply address indicia.

18. A mailer as recited in claim 15 wherein said reply address indicia is printed on said top face of said top ply, and wherein outgoing address indicia is printed on said top face of said top ply within said outgoing address area, and wherein said reply address indicia and said outgoing address indicia extend in the same, first, direction.

19. A mailer as recited in claim 15 wherein said return receipt is removably attached to said top ply by first and second parallel, spaced, strips of adhesive or spot pasted adhesive, remote from said outgoing address, and substantially parallel to said first fold line; and further comprising first and second lines of weakness formed in said return receipt adjacent said first and second strips of adhesive, said certified or registered mail number being provided between said first and second lines of weakness.

20. A mailer as recited in claim 19 further comprising an insert ply disposed between said top and second plies, and means for readily detachably mounting said insert ply between said top and second plies.

21. A return mailer as recited in claim 15 further comprising a certified or insured or registered mail number printed on said top face of said top ply between said return receipt and said first line of weakness; and wherein said flap portion of said second ply has sufficient length, when folded about said first fold line, to cover said mail number printed on said top face of said top ply.

22. A return mailer comprising:

a top ply having an outgoing address area with outgoing address indicia printed thereon, said top ply also having a bottom face;

a second ply connected to and cooperating with said top ply to forming an outgoing and reply envelope, said second ply having a top face facing said top ply bottom face, and a bottom face, said bottom face being devoid of address indicia;

reply address indicia printed on said top face of said top ply body portion, remote from said outgoing address area, said reply address indicia and said outgoing address indicia extending in the same, first, direction; and a return receipt for removably covering said reply address indicia, and having a top face visible when viewing the top face of said top ply, said top face having a certified or insured or registered mail number thereon, and a bottom face, said bottom face having receipt addressee indicia thereon.

23. A mailer as recited in claim 22 wherein said receipt addressee indicia comprises address information substantially identical to said reply address indicia.

24. A mailer as recited in claim 22 wherein said return receipt is removably attached to said top ply by first and second parallel, spaced, strips of adhesive or spot pasted adhesive, remote from said outgoing address, and substantially transverse to said first direction; and further comprising first and second lines of weakness formed in said return receipt adjacent said first and second strips of adhesive, said certified or registered mail number being provided between said first and second lines of weakness.

25. A mailer as recited in claim 22 further comprising an insert ply disposed between said top and second plies, and means for readily detachably mounting said insert ply between said top and second plies.

* * * * *